United States Patent [19]

Hogarth et al.

[11] Patent Number: 5,062,725

[45] Date of Patent: Nov. 5, 1991

[54] TYPEWRITER OR PRINTER RIBBON AND METHOD FOR ITS MANUFACTURE

[75] Inventors: Ian W. Hogarth, Turriff, England; Friedhelm Kiewning, Holo, Switzerland

[73] Assignee: Franz Buettner AG, EGG/ZH, Switzerland

[21] Appl. No.: 585,316

[22] Filed: Sep. 19, 1990

[30] Foreign Application Priority Data

Aug. 14, 1990 [DE] Fed. Rep. of Germany ..... 4025758

[51] Int. Cl.[5] ..... B41J 32/00

[52] U.S. Cl. ..... 400/195; 428/57; 428/221

[58] Field of Search ..... 400/195, 196.1, 202.4, 400/208, 248, 240, 240.4; 118/77; 428/57, 124, 221

[56] References Cited

U.S. PATENT DOCUMENTS

| | | | |
|---|---|---|---|
| 3,460,666 | 8/1969 | Ploeger, Jr. | 400/195 |
| 3,981,387 | 9/1976 | Gottschlich | 400/195 |
| 4,968,161 | 11/1990 | Kunitom et al. | 400/195 |
| 4,988,224 | 1/1991 | Furrow et al. | 400/195 |

FOREIGN PATENT DOCUMENTS

| | | | |
|---|---|---|---|
| 0017961 | 10/1980 | European Pat. Off. | 400/195 |
| 0190883 | 10/1984 | Japan | 400/240.4 |
| 62-216779 | 3/1986 | Japan . | |
| 0169270 | 7/1986 | Japan | 400/240 |
| 0169271 | 7/1986 | Japan | 400/240 |

OTHER PUBLICATIONS

"Endless Ribbon Feed", IBM Technical Disclosure Bulletin, vol. 7, No. 12, 5/65, pp. 1212–1213.

*Primary Examiner*—Eugene H. Eickholt
*Attorney, Agent, or Firm*—Darby & Darby

[57] ABSTRACT

A typewriter or printer ribbon with separate inked strips which extend in the longitudinal direction of the ribbon, and which are applied on a common, homogeneous support film. The inked strips are disposed on the front and back of the support film, perpendicularly to the longitudinal direction of the film, alternately offset to one another at equal intervals in such a manner that the back surface of the support film, which is opposite the coated side, is not coated. A method of manufacturing the typewriter or printer ribbon, wherein a wide support film is coated with several inked strips and then cut into suitable ribbons so that the inked strips are disposed on only one half of the front and only one one half of the back of the support film.

1 Claim, 1 Drawing Sheet

TYPEWRITER OR PRINTER RIBBON AND METHOD FOR ITS MANUFACTURE

FIELD OF THE INVENTION

This invention relates to ribbons for typewriters, printers, and the like, and the method of manufacturing the ribbon. More particulary, but not by way of limitations, the invention is directed to a ribbon having a plurality of separate, inked strips applied longitudinally onto the front as well as the back sides of a homogeneous support film in such a manner that pins or types on print heads do not come into surface contact with the inked strips.

BACKGROUND OF THE INVENTION

Typewriter or printer ribbons with separate inked strips are known. For example, German Offenlegungsschrift 1,436,756 discloses a ribbon with one inked strip for regular printing and another strip with correcting ink for covering mistakes.

Most conventional typewriter or printer ribbons are made of nylon. The nylon ribbon acts as a carrier for a colored liquid (usually an oil and ink mixture) which is absorbed by the fibers of the nylon. When the nylon impregnated with the colored liquid is hit by the pins of a print head on a dot matrix printer, or the print head of a conventional printer or typewriter, the colored liquid is forced out of the ribbon and transferred onto the paper being printed.

Following the transfer of the colored liquid onto paper, remaining colored liquid flows out of the surrounding areas back into the used zone to regenerate the typewriter or printer ribbon. Such conventional ribbons have colored liquid on both sides of the ribbon, so that the pins or types of the print heads, necesarilly, come into contact with the colored liquid. This contact limits the technical possibilities for the design of the print head because of the abrasive and caustic nature of conventional colored liquids; or, alternatively, the selection range of colored liquids that can be used is limited to the type of print head used.

Conventional coloring agents in colored liquids are either insoluble pigments or soluble dyes. Pigments are superior to dyes in both color yield and light stability, however, pigments are much more abrasive than dissolved dyes. Because of the superior quality of pigments in printing, the industry would use it preferrably over dyes if the abrasive effects of pigments on pin heads could be overcome. For instance, despite the fact that pigments cause serious abrasion and wear problems on printer heads and pins, pigments are, nevertheless, used by the industry on ribbons.

Present methods of attentuating the abrasive effects caused by pin heads coming into contact with pigments include having, as a general rule, less than 10% pigment in the colored liquid. Even with less than 10% pigment, it is still necessary to use expensive abrasion-resistant materials and lubricant systems for the print head construction to avoid the accelerated wear caused by print heads coming into contact with pigments during printing. Thus, there is a need in the industry for ribbon which are designed such that superior print quality pigments can be used while, simultaneously, preventing excessive wear of type or pin heads.

Backing films are sometimes used in typewriter or printer ribbons and have certain advantages over nylon. In conventional ribbons with backing film, the colored liquid is coated onto support film. When insoluble pigments are used in the colored liquid coating, the film can act as a buffer layer shielding the print head from the pigments. The film can be constructed in such a manner that the pins never penetrate the support film, and, thus, would not come into contact with the coating. With such construction, abrasion on print heads is caused only by ordinary wear and tear caused by constant contact of the printhead with the support film.

However, the trade-off in using backing film instead of nylon is the limited use obtained from a roll of coated film. Unlike nylon which can regenerate used zones as described above, the coated film can only be used for one linear pass-through and its surface cannot be regenerated in the form of a continueing loop. Thus, the confines of the internal space of a typewriter or printer limit the amount of backing film that can be placed into a ribbon cassette or cartridge. The user of such designs is constantly replacing spent cassettes leading to poor economic efficiency in terms of man-hours and the cost of constant replacement.

It is, therefore, an object of the present invention to provide a typewriter or printer ribbon with superior color yield while preventing excessive wear of pin or type heads caused by abrasive pigments, and, further, provide extended duration of use before discarding and replacement.

To this end, the present invention incorporates onto support film, inked strips disposed alternately offset with respect to one another at equal intervals on the front and back of the support film and perpendicular to the longitudinal direction of the support film so that the "back" of the support film, which is opposite the coated side, has no ink. Furthermore, a Moebius loop is utilized and the ends of the ribbon are joined into a continous loop by means of conventional adhesive strips in a manner which doubles the useful life of the ribbon of the present invention.

SUMMARY OF THE INVENTION

The typewriter or printer ribbon of the present invention is produced by coating a support film with inked strips on both surfaces of the film. (For convenience the surface facing a type or pin head will be referred to as the "front" and the coated surface, the "back".) The inked strips are coated perpendicularly to the longitudinal direction of the support film, alternately offset with respect to one another at equal intervals in such a manner that the inked strips are linearly disposed only on one-half of the front and only on one half of the back.

The two ends of the treated film strip ribbon are connected via a Moebius loop, that is, one end of the ribbon is rotated about the longitudinal axis of the strip through 180 degrees relative to the other end. The two ends are then connected to one another by means of conventional adhesive strips, which are applied on the uncoated half of the front and back. When the two ends are connected, a "twisted", continous Moebius loop results.

The Moebius loop construction of the present invention doubles the usage obtained from the inked ribbon. Only one-half of the total width of the ribbon is used for printing at any given time. When the ribbon passes through one cycle of the Moebius loop within the cassette, it is reversed. The unused half is now cycled for further printing, thus, the surface area of available ink is doubled.

Moebius loops could be used with nylon ribbon since ink is effectively distributed throughout the nylon fabric and an effective image can be obtained when the ribbon is acted upon from either surface of the ribbon. However, type or pin heads still make contact with abrasive pigments, and excessive wear cannot be prevented. Furthermore, because colored liquid is dispersed throughout the nylon fabric, connection of the ends of a nylon ribbon is not feasable with inexpensive adhesive tapes. Instead, sophisticated connection methods such as ultra sound is required which pose complicated production problems.

The ends of the ribbon of the present invention are joined together by means of conventional adhesive strips to form the Moebius loop, the adhesive strips being disposed on opposite, uncoated sides of the ribbon. This simple adhesion provides an economic method for manufacturing the ribbon of the present invention.

Various methods of applying ink coats onto support film are known to those skilled in the art. The ink coats of the present invention are applied to large sheets of film in linear strips the width of conventional typewriter or printer ribbons. The coating strips are applied on both surfaces of the film sheet at specified, pre-determined intervals such that strips are coated in an alternating pattern, one on the front surface, the next on the back surface etc.

The sheet is then cut into linear strips at the center of each applied coating. This produces ribbon with coating on one-half of the front surface and on the other half of the back surface. Thus, a very economic and simple method of producing the ribbon is provided which requires minimal coat applicationse. The ribbon can be disposed in a Moebius loop in a cassette or cartridge, joined together at the ends by means of conventional adhesive strips on the uncoated half of the front and on the uncoated half of the back of the ribbon.

Thus, type or pin heads come into contact only with the uncoated side of the support film of the present invention during printing. In this manner abrasive, pigmented ink coatings, which have better color yield and light stability, can be used without fear of accelerated wear. This results in better print quality due to sharper, denser and clearer contours. In the case of dotmatrix printers, the pins do not penetrate the support film, so that pins with a smaller diameter can be used.

In addition, the use of the Moebius loop ribbon in a cassette or cartridge, doubles the useful life of the ribbon because only one-half of the width of the ribbon is used at any given time with the unused half utilized when the loop completes one cycle. This allows for compact cartridges and cassettes for use in machines with limited space. These and other improvements will be apparent.

DETAILED DESCRIPTION

Figure 1:
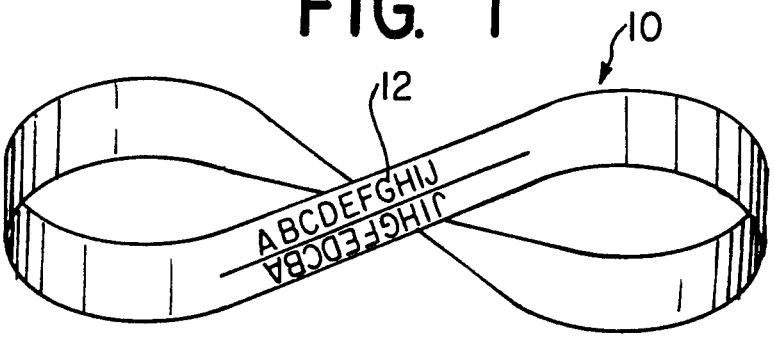
FIG. 1 depicts a perspective view of the typewriter or printer ribbon disposed in a Moebius Loop.

FIG. 1 depicts the typewriter or printer ribbon, generally designated with the numeral 10, in a Moebius loop. The Moebius loop is formed by connecting the two ends of the ribbon, for example, by gluing or welding adhesion, by twisting one end, before it is connected, through a 180 degree turn about the longitudinal axis of the typewriter or printer ribbon relative to the other end.

The numeral 12 designates how type symbols or characters are imaged on ribbon 10, during printing, indicating positions where the coating was transferred to a paper. The mirror image symbols and characters show positions which were transferred from the coating on the previous cycle, thus, now are on the back surface. The regular imaged symbols or characters were transferred from a coating in the cycle depicted in FIG. 1, thus, are on the front surface.

Figure 2:
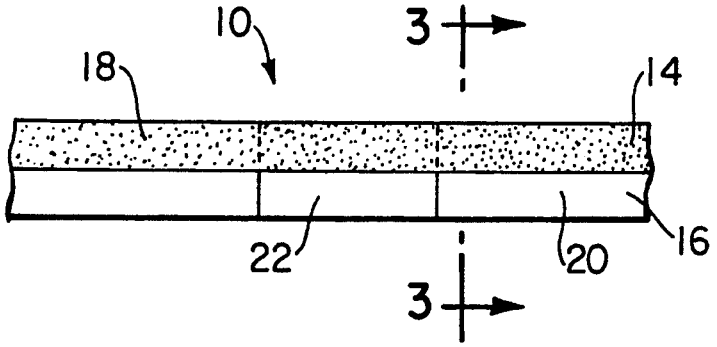
FIG. 2 shows a plan view of one surface of the typewriter or printer ribbon, depicting one linear-half with coating and the other linear-half without coating.

FIG. 2 depicts a section of ribbon 10 shown from an elevated, plan view. Two end sections of ribbon 10 are shown joined together by means of an adhesive strip 22. Coating 18 is shown on the front surface of ribbon 10 in shade which represents an inked strip on upper half 14 of ribbon 10. A corresponding coating (not shown) is disposed on lower half 16 on the back surface of ribbon 10. Adhesive strip 22 has a width one half the width of ribbon 10, and is disposed on the coating-free, lower half 16 of the front surface. Another adhesive strip (not shown, but visualized with dotted lines) is disposed on upper half 14 on the back surface of ribbon 10.

Figure 3:
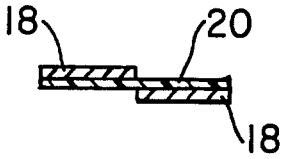
FIG. 3 shows a sectional view along line III—III of FIG. 2, depicting the relative positions of the linear-coatings on the front and back surfaces of the ribbon.

FIG. 3 shows ribbon 10 in section along line III—III in FIG. 2. The top half of support film 20 is provided with coating 18 on the front surface, and the other half is provided with another coating 18 on the back surface of film 20.

Figure 4:
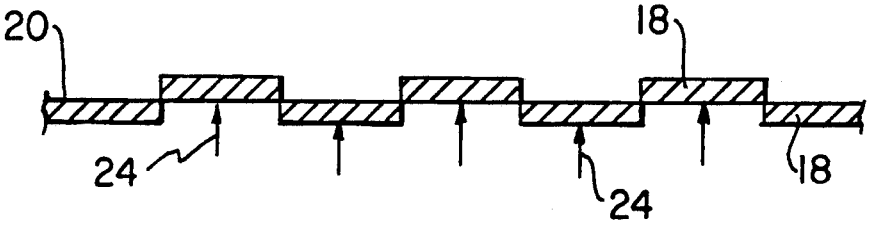
FIG. 4 shows a diagrammatic view of the sheet coating process for the manufacture of the ribbon of the present invention. Arrows, collectively labeled 24, depict points at which the coated sheet is cut linearly resulting in the desired ribbons of the present invention.

In FIG. 4, the method of manufacturing ribbon 10 is shown diagrammatically. A wide support film sheet 20 is alternately coated on its front and back surfaces with an inked coating 18. Between two adjacent inked strips on either surface, an uncoated region is left in intervals of width equal to the width of the coating. The film is then cut in longitudinal strips at points indicated with arrows 24. By these means, a typewriter or printer ribbon of the inventive structure is obtained. Subsequently, a Moebius loop is formed and the ends of the ribbon are joined by applying adhesive strips to both the uncoated surfaces of the front and back. Finally, the typewriter or printer ribbon is disposed in a cassette or cartride using conventional methods.

We claim:

1. A method for the manufacture of typewriter or printer ribbons comprising the steps of:

coating a support film with a plurality of inked strips offset relative to one another at equal, predetermined intervals and alternatively on the front and back surfaces of said film;

cutting said film into linear ribbons along a longitudinal direction such that only one half of said front surface and only one half of said back surface is coated with said inked strips;

rotating said ribbons individually through 180 degrees about its longitudinal axis; and connecting the ends of said individual ribbons by adhesive means applied to surfaces of the ribbons not coated with ink.

* * * * *